US009163901B2

(12) United States Patent
McMahon et al.

(10) Patent No.: US 9,163,901 B2
(45) Date of Patent: Oct. 20, 2015

(54) GUIDANCE SECTION CONNECTOR INTERFACE FOR ADVANCED ROCKET LAUNCHERS

(71) Applicant: Raytheon Company, Waltham, MA (US)

(72) Inventors: Roy P. McMahon, Waltham, MA (US); Michael R. Hlavek, Waltham, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/070,250

(22) Filed: Nov. 1, 2013

(65) Prior Publication Data

US 2015/0122113 A1 May 7, 2015

(51) Int. Cl.

| | |
|---|---|
| ***F41F 3/055*** | (2006.01) |
| ***F41F 3/06*** | (2006.01) |
| ***F42B 15/01*** | (2006.01) |
| ***B64G 1/64*** | (2006.01) |

(52) U.S. Cl.

CPC ..... *F41F 3/055* (2013.01); *B64G 1/645* (2013.01); *F41F 3/06* (2013.01); *F42B 15/01* (2013.01)

(58) Field of Classification Search

CPC ..... F41F 3/055; F42B 15/01; F42B 15/04; B64G 1/64; B64G 1/645

USPC ..... 89/1.811, 1.813, 1.814

See application file for complete search history.

(56) References Cited

U.S. PATENT DOCUMENTS

| | | | | |
|---|---|---|---|---|
| 3,072,021 | A * | 1/1963 | Marcon | 89/1.811 |
| 3,193,790 | A * | 7/1965 | Boyle et al. | 439/160 |
| 2008/0006735 | A1 * | 1/2008 | Fein et al. | 244/3.15 |
| 2009/0194641 | A1 * | 8/2009 | Haase | 244/224 |

FOREIGN PATENT DOCUMENTS

| | | | |
|---|---|---|---|
| EP | 1 098 400 | A2 * | 5/2001 |

* cited by examiner

*Primary Examiner* — Stephen M Johnson

(57) ABSTRACT

A guidance section connector interface system operable with smart or guided rockets to be launched from a rocket launcher comprising a rocket connector of a rocket in electronic communication with a guidance system of a guidance head of the rocket, a connector saver, and a launcher connector of a rocket launcher. The connector saver can be configured to connect the rocket connecter to the launcher connector. The connection between the connector saver and the rocket connector is configured to release upon launching the rocket, wherein the connector saver remains connected to the launcher connector to protect the launcher connector from the extreme conditions within the rocket launcher at launch.

20 Claims, 7 Drawing Sheets

GUIDANCE SECTION CONNECTOR INTERFACE FOR ADVANCED ROCKET LAUNCHERS

BACKGROUND

Rocket launchers have been widely used to transport and fire a payload of one or more rockets at a given target. These rocket launchers have been used on a variety of land and air vehicles acting as a firing platform for the rocket launcher. However, until recently the rockets used in these rocket launchers have been relatively primitive aim-and-shoot type rockets with no guidance or no intelligent or smart communication with the rocket beyond a firing mechanism triggering the launch of the rocket from the launcher. Part of the reason for this is that electrical connections between the rocket and the launcher are subjected to extreme conditions, particularly upon rocket launch. With the advancement of rockets and their ability to comprise on-board guidance and other technology, there is a need for reliable electrical communication between the rockets and rocket launchers.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
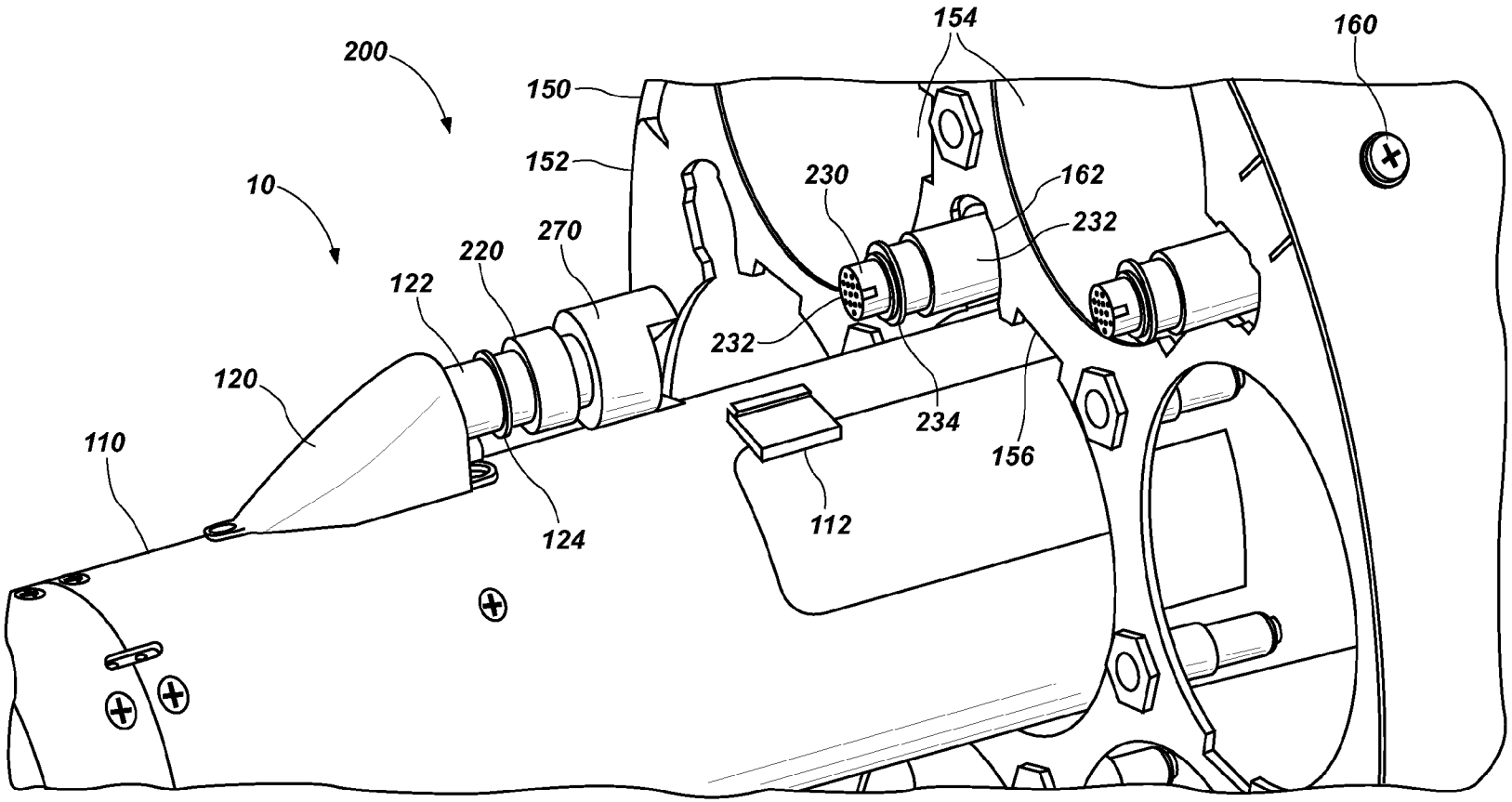
FIG. 1 illustrates a partial isometric view of a rocket launching system having guidance capabilities, the rocket launching system having a guidance section connector interface system in accordance with one exemplary embodiment of the present invention, FIG. 1 illustrating the rocket as being partially inserted into the rocket launcher and the guidance section connector interface system in a decoupled or separated arrangement.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Rocket launchers, as discussed above, have historically been simple point-and-shoot mechanisms which have, in the past, shot only "dumb" rockets that fire in the direction pointed when fired. Recent advancements in ballistics and smart missiles have enabled existing rocket launchers to be retrofitted to contain smart rockets with onboard guidance systems. With the application of new smart rockets in existing launching systems different forms of electrical connection have been established between an end control system and the guidance system or guidance head on each individual rocket. However, this connection between the rocket, generally located somewhere between the rocket and the rocket launcher, is typically subjected to extreme conditions, namely the exhaust or rocket blast, upon launch of the rocket from the rocket launcher. The connector on the rocket launcher, hereinafter referred to as the launcher connector, as subjected to high intensity blasts, particularly in the event of numerous launches over time, may become damaged and unable to operate correctly. Further, rocket launchers and rockets may often be utilized in war or battle scenarios where reloading times may need to be reduced to a minimum in order to allow the vehicle or other platform firing the rocket to return to a ready-to-fire state as soon as possible.

The present invention provides a rocket launching system comprising a guidance section connector interface system capable of providing or facilitating a "smart" connection between the rocket and the rocket launcher (and ultimately the end control system), while at the same time preserving the integrity of the launcher connector to facilitate repetitive "smart" rocket launches. Some embodiments of the rocket launching system and the guidance section connector interface system can further allow easy handling and quick reloading capabilities.

Figure 2:
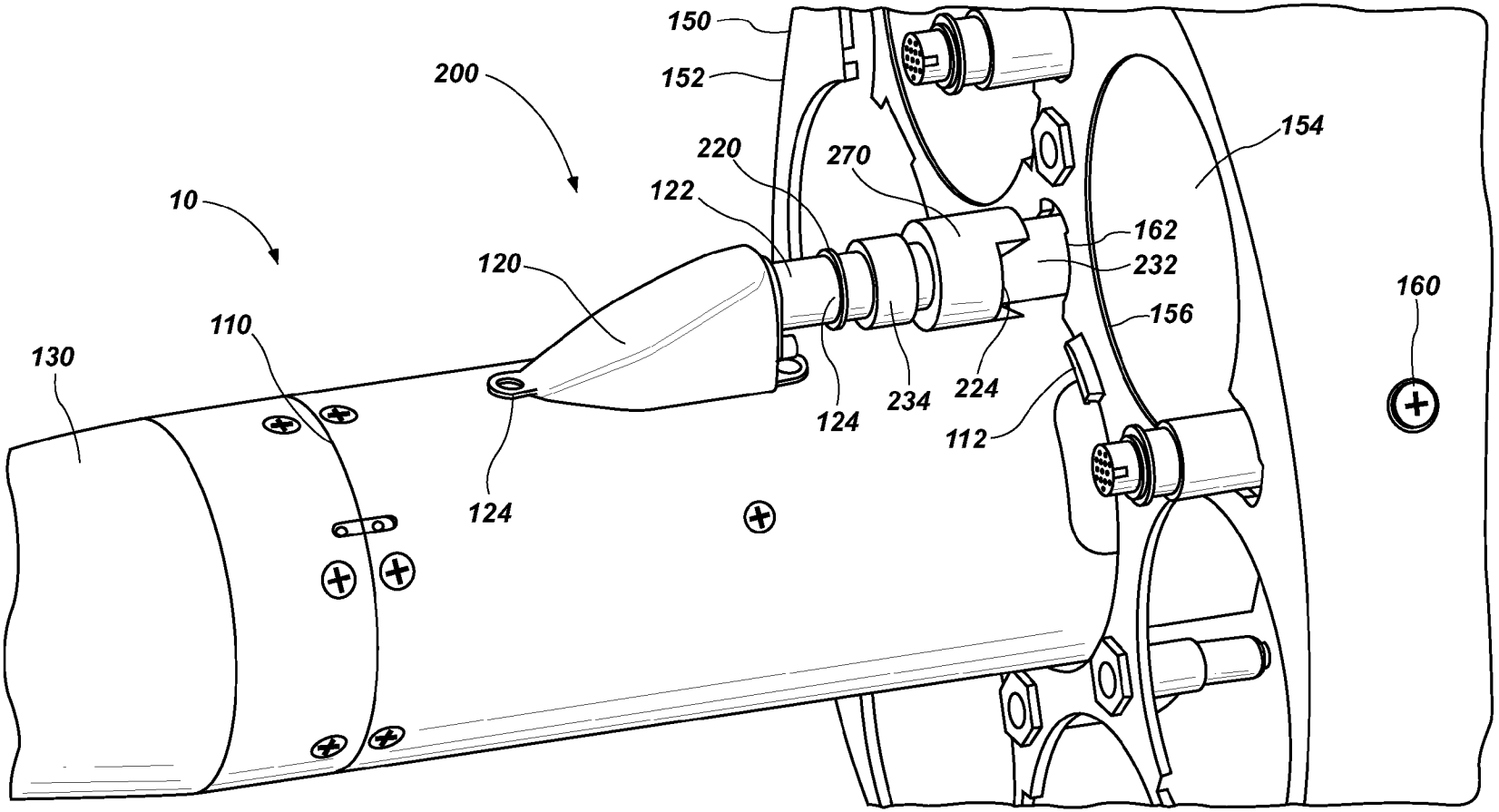
FIG. 2 illustrates a partial isometric view of the rocket launching system of FIG. 1, wherein the rocket is fully inserted into the rocket launcher, with the guidance section connector interface system in a coupled arrangement.
Figure 3:
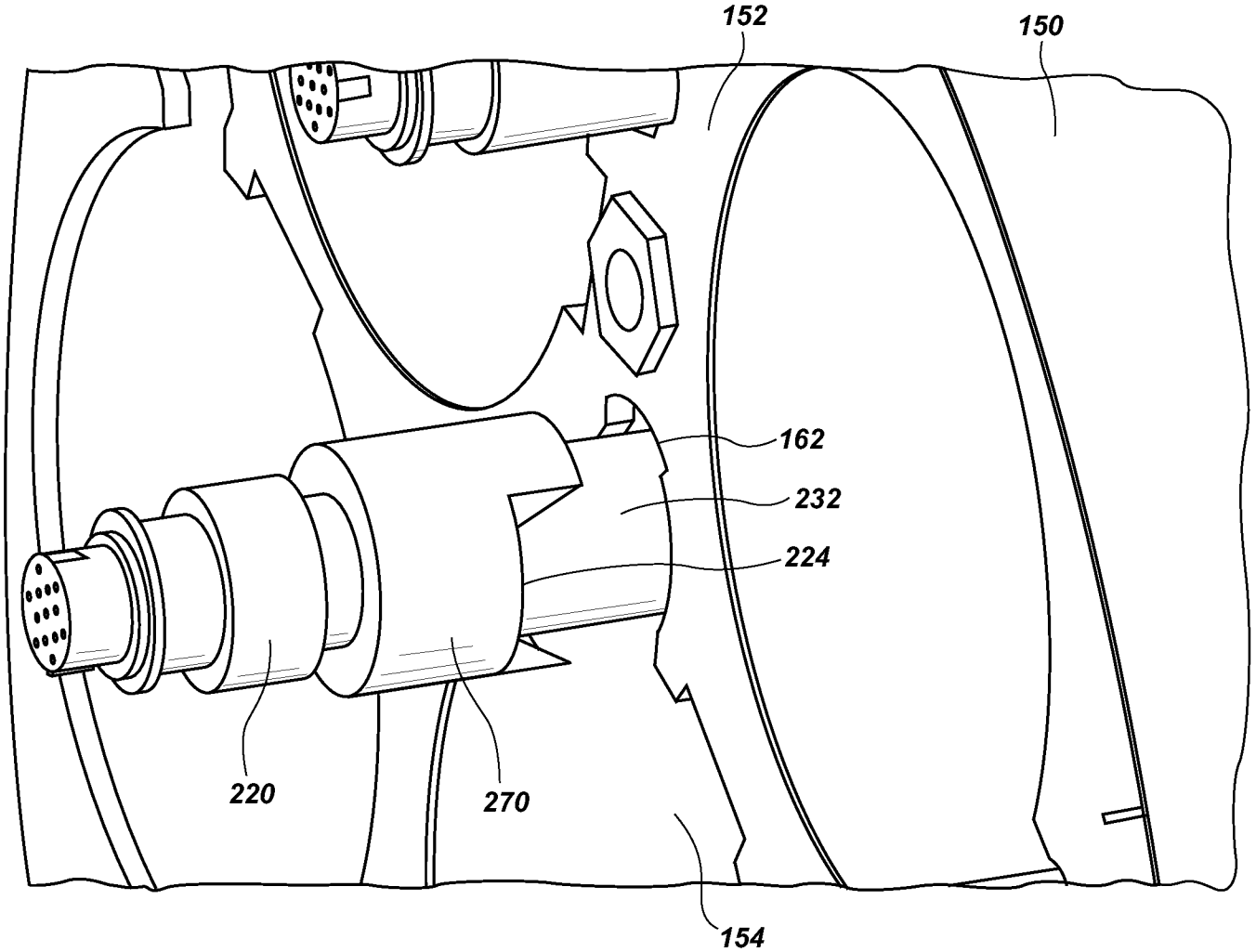
FIG. 3 illustrates a partial isometric view of a portion of the guidance section connector interface system of FIG. 1 at a point after the rocket is launched from the rocket launcher.

With reference to FIGS. 1-3, illustrated is a rocket launching system in accordance with one exemplary embodiment.

The rocket launching system 10 comprises a guidance section connector interface 200, which facilitates "smart" electrical communication between a rocket 110 and a rocket launcher 150 (and an end control system as discussed herein), meaning at a minimum that the rocket comprises guidance capabilities (e.g., on-board components that facilitate this, such as processor(s), memory, GPS, signal transceivers, etc.), and is able to communicate (i.e., send information back and forth) with a control system. The guidance section connector interface 200 facilitates easy loading of the rocket 110 into the rocket launcher 150, and provides protection of a permanent launcher connector 230 located on or otherwise supported about the rocket launcher 150. Particularly, FIGS. 1-3 depict various stages, respectively, of the process of loading the rocket 110 to launching the rocket 110. In particular, FIG. 1 shows the rocket 110 being partially inserted into the rocket launcher 150. FIG. 2 shows the rocket 110 being fully inserted into the rocket launcher 150 where the guidance section connector interface 200 is fully connected. FIG. 3 shows the rocket launcher 150 after the rocket 110 has been launched, wherein a portion of the guidance section connector interface 200 (namely the connector saver 220) originally on the rocket 110 is coupled to and ultimately remains on the rocket launcher 150 after launch.

Referring again to FIGS. 1-3, the rocket 110 can be inserted into one of a plurality of rocket guide sleeves 154 of the rocket launcher 150. While the rocket launcher 150, as shown, has a plurality of rocket guide sleeves 154, those skilled in the art will also appreciate that a rocket launcher may comprise a single rocket guide sleeve. In the present embodiment of the invention, the guidance connector section interface 200 can comprise a sacrificial connector saver 220, which can be utilized to preserve the integrity of the launcher connector 230 during a rocket launch. Initially, the connector saver 220 can be removably coupled to a connector located on or otherwise supported about the rocket, hereinafter referred to as a rocket connector 122, thus forming a first connection 124. The rocket connector 122 can comprise an electrical interface that provides an electrical connection to a guidance head 130, which electrical connection can be protected by and extend through a rocket connector shroud 120. The rocket 110 can be slid into and supported within a rocket guide sleeve 154 of the rocket launcher 150, through a front face 152 of the rocket launcher 150. As the rocket 110 is slid into the rocket guide sleeve 154, the connector saver 220 can be caused to make a second connection 224 by mating with, and electrically connecting to, the launcher connector 230, which is further in electric communication with a control system having a control panel, which control system may be located on the rocket launcher 150 or in a remote location, such as within a vehicle, wherein the control system can be configured to communicate with the rocket 110 and/or the rocket launcher 150, such as to relay or transmit preprogrammed guidance information to the rocket 110 or to program the rocket 110 to comprise specific guidance information, thus enabling a "smart" rocket capable of carrying out a set of instructions or commands pertaining to post launch actions. For example, a "smart" rocket may comprise information pertaining to launch timing, targeting based on information such as GPS coordinates or other input, flight control (e.g., velocity, altitude, etc.), detonation based on time or altitude or location coordinates, or a combination of these and any others recognized by those skilled in the art.

Further, a dummy rocket shroud (not shown) may be provided opposite the rocket connector shroud 120 through which the rocket connector 122 is affixed. This dummy shroud can be provided cover the portion of the guidance section connector interface associated with the rocket 110, for example, to equalize wind resistance or drag on each side of the rocket 110 during flight after launch.

The second connection 224 can be designed to be the dominant connection over the first connection 124. Stated differently, the first connection 124 can be designed to separate or decouple in favor of the second connection 224 upon launching of the rocket 110. Configuring the second connection 224 in this manner ensures that when the rocket 110 is launched, the connector saver 220 will remain connected or coupled to the launcher connector 230, thus allowing the connector saver 220 to protect the launcher connector 230 by shielding the launcher connector 230 from the blast of the rocket 110. In one aspect, the connector saver 220 can be configured to receive the launcher connector 230 within an interior portion of the connector saver 220, thus causing a portion of the connector saver 220 to extend around and about the launcher connector 230, thus serving as a shroud or protector situated about the launcher connector 230.

It will be recognized by those skilled in the art that a variety of forms or types of interfaces or connections can be used to provide a suitable connection between the connector saver 220 and the launcher connector 230, so long as the first connection 124 is designed to separate or decouple in favor of the second connection 224. In one exemplary embodiment, the first connection 124 can comprise a type of press, friction, or interference fit, while the second connection 224 can comprise an automatic locking or coupling mechanism that dominates the first connection 124 by facilitating decoupling of the first connection during launch of the rocket while maintaining coupling of the second connection 224. Exemplary connections contemplated herein for forming the first connection 124 include, but are not limited to, press fit, friction fit, or interference fits including interlocking lip and corresponding hollows, each of which may or may not require some level of plastic or elastic deformation to form the connection. Exemplary connections contemplated herein for forming the second connection 224 include, but are not limited to, automatic locking or coupling mechanisms, press fit, friction fit, interference fit, and others, including those taught with respect to the first connection 124, provided these are made to be dominant over the first connection 124 such that they do not release prior to or before the second connection 224.

More specifically, the coupling or locking mechanisms contemplated for forming the second connection 224 may include quick-connect type systems with sliding lock collars, such as those used for pneumatic air hose connections. Additional connections for the second connection 224 may include snap rings, push-pull type connections, electromagnets, threaded collars or any other type of auto locking connector as will be recognized by one of ordinary skill in the art. It has been discovered that quick-connect type systems are of some advantage as they provide a reliable connection and may be attached and removed relatively quickly.

It will be appreciated that the various connecting components within the guidance section connector interface 200 (i.e., those components supported on the rocket and those supported on the rocket launcher) should be properly aligned to achieve an effective and proper connection. In one aspect, alignment can be achieved prior to locating the rocket 110 in its fully loaded position. It will also be recognized that common rocket launchers have a plurality of rocket guide sleeves 154 arranged in a tight proximity one to another which may result in a degree of difficulty in easily recognizing which launcher connector 230 corresponds to which rocket guide sleeve 154. In order to facilitate quick loading and reloading of a plurality of rockets, and to ensure proper alignment of the components of each of the guidance section connector interface systems 200 respectively associated with the several different rockets and the rocket launcher, the rocket launching system 10, or each of the guidance section connector interface systems, can further comprise a clocking system. The clocking system can be configured to facilitate alignment of the rocket 110 in the correct angular orientation or position within the rocket guide sleeve 154 of the rocket launcher 150 into which the rocket 110 is inserted, and about the longitudinal axis of the rocket guide sleeve 154. In one embodiment of the present invention the clocking system can comprise a slot 156 formed into the front face 152 of the rocket launcher 150. A guide 112, which can be located on and supported about the outer surface of the rocket 110, can be configured to correspond in size and shape to, and fit within, the slot 156. This can be achieved with a relatively small clearance. The guide 112 and slot 156 can ensure proper clocking and alignment of the rocket connector 122 (having coupled thereto the connector saver 220) and the launcher connector 230 as the rocket 110 is inserted completely into the rocket launcher 150 in the aft direction. This can be achieved as the guide 112 will be caused to contact the front face 152 of the rocket launcher 150, the guide acting as a stopper preventing further insertion of the rocket 110 into the guide sleeve 154 of the rocket launcher 150 if the angular orientation of the rocket 110 relative to the guide sleeve 154 is out of an acceptable range. To achieve full insertion of the rocket 110 into the guide sleeve 154, the rocket can be rotated about its longitudinal axis to align the guide 112 up with the slot 156, wherein the guide 112 can be caused to pass through the slot 156 to achieve complete insertion of the rocket 110 within the rocket launcher 150. In one exemplary embodiment, the clocking system may be configured, such that the guide 112 and slot 156 are located about the rocket 110 and rocket launcher 150, respectively, so that the guide 112 passes through the slot 156 at a point in time just prior to connection of the rocket connector 122 and the connector saver 220 with the launcher connector 230. In another exemplary embodiment, the clocking system can comprise a guide that runs along the rocket and that extends to an end of the rocket, such that alignment is achieved before any part of the rocket is received within the guide sleeve 154 of the rocket launcher 150.

With reference to FIGS. 1-4 and 6, it will be appreciated that electrical connections can often be provided via a plurality of pin-type connections. The use of pin-type connections, and many other electrical connections, typically require the connecting components to be properly aligned before the connector pins are pushed into their counterpart receptors. While the clocking system, as discussed above, provides a certain degree of alignment, it may be necessary to provide additional, more precise or fine alignment so as to reduce stress and wear on the pins and connectors upon rocket loading, which may provide increased reliability and a longer usable life of the connectors, particularly the launcher connectors 230. In order to facilitate a more precise or fine alignment of connector components, a funnel 270 may be utilized between the connector saver 220 and the launcher connector 230.

In one exemplary embodiment, the funnel 270 can comprise a tapered conical interior 272 of a larger diameter than the launcher connector 230, which can be configured to guide the connector saver 220 into proper alignment with the launcher connector 230 and any pins and pin holes associated therewith (e.g., pins of the connector saver 220 designed for insertion into pin holes 232 of the launcher connector 230). The funnel 270 may be permanently affixed to the connector saver 220 using any suitable means, such as by gluing or epoxying. In another embodiment, the funnel 270 can be unitarily formed with the connector saver 220. In still another embodiment, the funnel 270 can be removably coupled to the connector saver 220, such as via threads. The present embodiment depicts the use of threads 274 for affixing the funnel 270 to the connector saver 220 using a threaded connection. However, those skilled in the art will recognize that other types of suitable means may be used for removably affixing the funnel 270 to the connector saver 220.

For purposes of the present invention, the connection between the connector saver 220 and the funnel 270 can be configured to be more dominant than the first connection 124 in order to ensure the connector saver 220 (and the funnel 270) remain on the launcher connector 230 during a rocket launch as the guidance section connector interface is caused to separate or decouple. In the event the funnel 270 is used, the funnel 270 can be configured and caused to engage and mate with the launcher connector 230 in any manner similar to the connector saver 220 as discussed above, including push-pull and quick-connect type systems. In addition to the connection types discussed above with respect to the connector saver 220 and the launcher connector 230, the funnel 270 may have tapered tabs 276 on an interior surface which may snap onto or over a flange edge 234 of the launcher connector 230, such that the funnel 270 is caused to snap onto the launcher connector 230 as the rocket 110 is loaded into the rocket launcher 150 and the various components and connection elements of the guidance section connector interface 200 are caused to couple together.

Additionally, it should be noted that the connector saver 220 and funnel 270 components can be formed of any suitable material. In one example, aerospace plastic can be used, which has proven to be particularly effective as it is relatively easy to machine and it is reliable.

Figure 4:
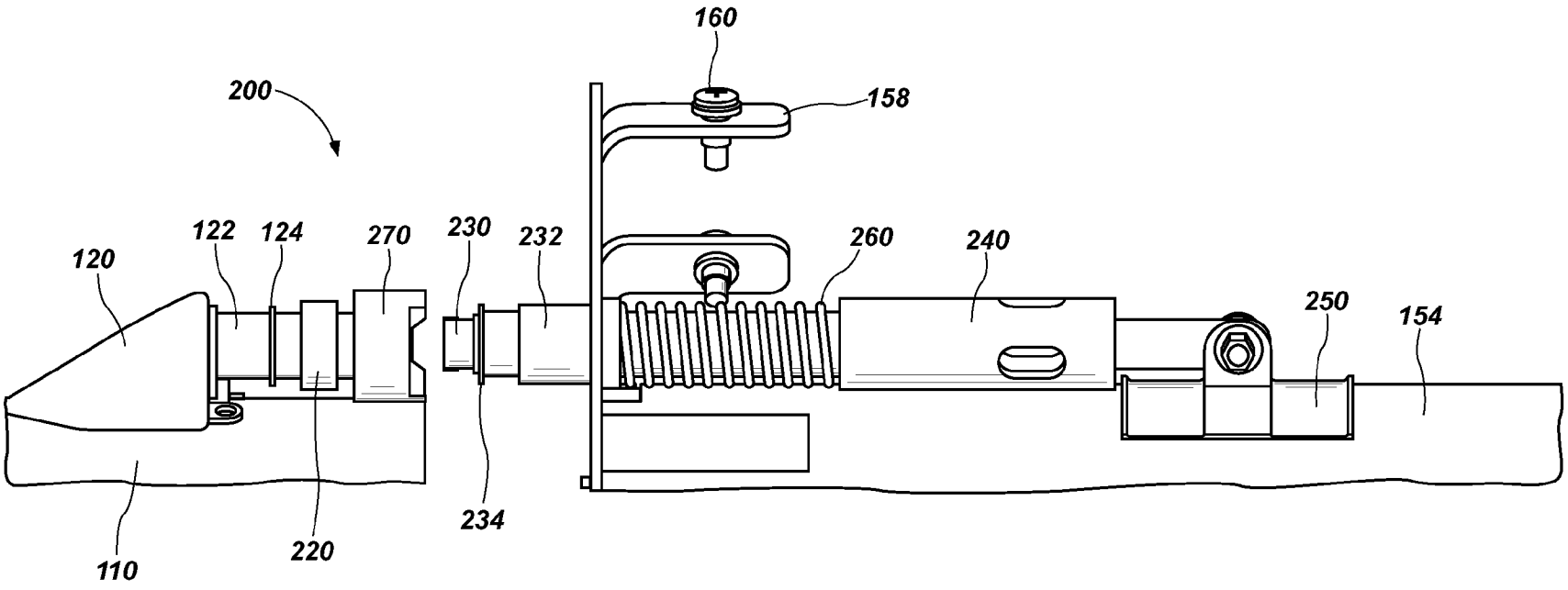
FIG. 4 illustrates a partial side sectional view of the guidance section connector interface system of FIG. 1.
Figure 5:
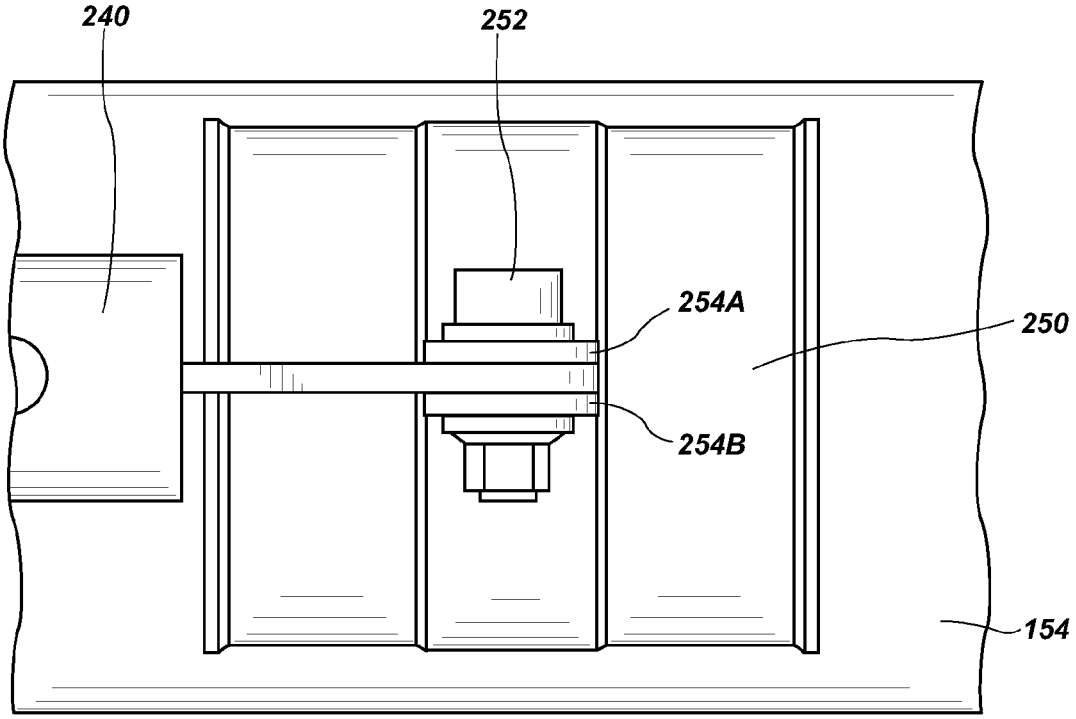
FIG. 5 illustrates a partial top view of the guidance section connector interface system of FIG. 1.
Figure 6:
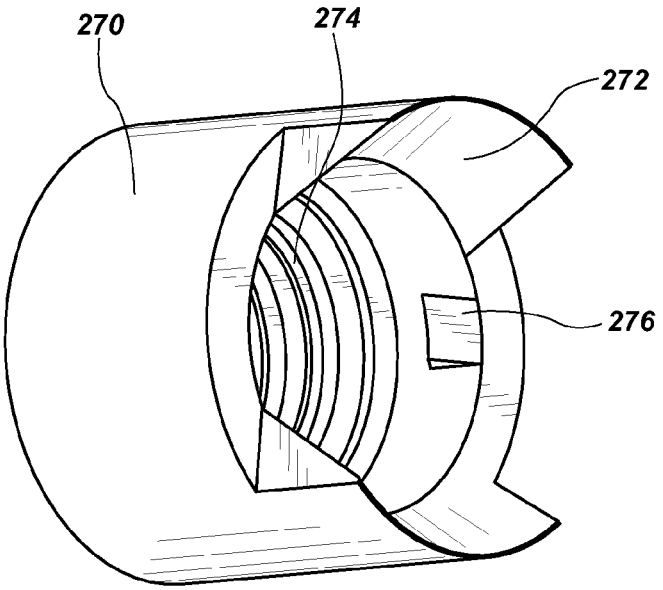
FIG. 6 illustrates an isometric view of an intermediate funnel component of the guidance section connector interface system of FIG. 1.

With reference to FIGS. 3-5, the guidance section connector interface 200 comprises the launcher connector 230, which can be coupled to or otherwise supported about a slideable shaft 232. The slideable shaft 232 can comprise a first end configured to extend through the front face 152 of the rocket launcher 150, wherein the launcher connector 230 can be supported about the first end of the shaft 232. The first end can be configured to extend through a hole 162 formed in the front face 152 proximate the rocket guide sleeve 154, wherein the slideable shaft 232 can be supported by the front face 152. The hole 162 can be configured to provide some clearance between the edges of the front face 152 defining the hole 162 and an outer surface of the slideable shaft 232, which clearance can facilitate a certain degree of float of the slideable shaft 232 permitting the launcher connector 230 and the slideable shaft 232 to move or displace along orthogonal axes (e.g., the x and y axes) as the launcher connector 230 is caused to engage the funnel 270 upon loading or inserting the rocket 110 into the rocket launcher 150. Indeed, due to the floating capabilities of the above described components of the guidance section connector interface 200, the launcher connector 230 can be guided into a proper mating position with the connector saver 220 upon engaging the funnel 270, and therefore the rocket connector 122.

The slideable shaft 232 can be supported at a second end by a shaft receiver 240. The slideable shaft 232 can be inserted into an interior portion of the shaft receiver 240 and rotatably and/or slidably supported therein, the slideable shaft 232 specifically being configured to slide co-axially relative to the shaft receiver 240. This sliding function allows the launcher connector 230 to be initially in an outward position, and then to move inward as the rocket 110 is inserted into the rocket launcher 150. Specifically, the launcher connector 230 can be initially positioned a certain distance forward from the front face 152, allowing for an electrical connection to be established prior to full insertion of the rocket 110. This ability to position the launcher connector 230 farther forward initially, and then to subsequently be able to be caused to slide back during rocket insertion allows for a certain degree of error in placement of the rocket connector 122 on each individual rocket 110, such as to facilitate a proper and operable electrical connection in the event a rocket 110 is not fully inserted into the rocket launcher 150.

The guidance section connector interface 200 can further comprise a biasing member, such as a rubber member, a spring 260, etc., configured to bias the sliding shaft 232 and therefore the launcher connector 230 in the forward direction. This spring 260 can provide a biasing force sufficient to ensure a proper connection and ensure that the inserted rocket 110 and corresponding rocket connector 122 does not just push the launcher connector 230 down without establishing an electronic connection. It should be appreciated that the shaft receiver 240 may receive the sliding shaft 232 into a hollow within the shaft receiver 240 or the shaft receiver 240 may be received in a hollow within the sliding shaft 232, so as to allow this relative sliding motion with the spring 260 providing the discussed biasing force. It should be noted that the spring can be appropriately sized and configured so that a user of the rocket launcher is still able to push the rocket in the aft direction after the electrical connection is made to cause engagement of a detention mechanism (not shown) as part of a normal operation of the rocket launcher.

The shaft receiver 240 can be coupled to a coupler 250 which can be affixed to the rocket launcher 150. The connection between the coupler 250 and the shaft receiver 240 may be provided via a hinge assembly that is also part of the guidance section connector interface system, the hinge assembly comprising a pin 252 operable with the coupler that allows the shaft receiver 240 (and the slideable shaft 232) to pivot relative to the coupler 250, which pivoting function facilitates the capability of the slideable shaft 232 (and the launcher connector 230) to float in a bi-directional manner relative to the hole 162 located on the front face 152 of the rocket launcher 150, as previously discussed. Additionally, clearance between the coupler 250 and the slideable shaft 240 can be provided by the hinge assembly, and particularly gaps 254A and 254B. These gaps 254A and 254B can permit the shaft receiver 240 to float in different directions, therefore allowing the slideable shaft 162 to similarly float. More specifically, the hinge assembly can be configured to permit the shaft receiver 240 and slideable shaft 232 (and launcher connector 230) to rotate along a first axis (e.g., a longitudinal axis of the slideable shaft 232) as well as along a second axis (e.g., axis into the page of FIG. 5). As such, the hinge assembly of the guidance section connector interface 200 can provide movement about multiple degrees of freedom, such as rotation about three axes (e.g., x, y and z), as well as a translational degree of freedom with the slideable shaft able to displace relative to the shaft receiver 240. It should be appreciated that the coupler 250 is shown as being affixed to an outer surface of a rocket guide sleeve 154 of the rocket launcher 150. In other embodiments, the coupler 250 can be affixed to the rocket launcher in any suitable location or manner which provides proper alignment of the slideable shaft 232 through hole 162.

With reference to FIGS. 1, 2, and 4, shown is the front face 152 of the rocket launcher 150, which can be coupled to the rocket launcher 150 via tabs 158 and fasteners 160. However, these are not meant to be limiting in any way as the front face 152 may be affixed to the rocket launcher 150 in any suitable manner as will be appreciated by one of ordinary skill in the art.

Figure 7A:
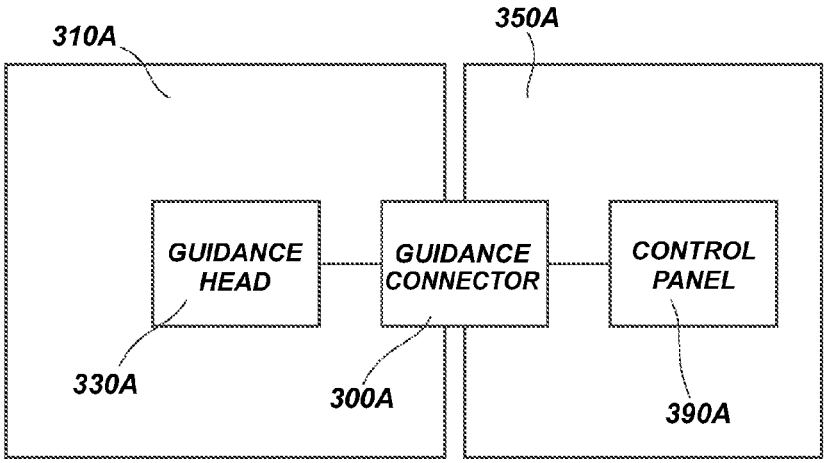
FIGS. 7A and 7B illustrate an electrical schematic of the electrical connection or communication between the rocket and a control panel as conveyed through a guidance section connector interface system in accordance with one exemplary embodiment of the present invention.

With reference to FIG. 7A, shown is an electrical schematic of the electrical communication between the guidance system supported within the guidance head 330A located on a rocket 310A and a control panel 390A located on a rocket launcher 350A. The guidance section connector interface 300A facilitates an electrical connection by way of its interface between the guidance system of the guidance head 330A of the rocket 310A and the control panel 390A located on the rocket launcher 350A. Communication can be carried out over a wired connection, or wirelessly. By having the control panel 390A located directly on the rocket launcher 350A, the rocket launcher 350A itself can be configured to communicate with the guidance system of the guidance head 330A. In one example, the user of the rocket launcher 350A can operate the control panel 390A to supply the guidance system with needed information, such as guidance or targeting information.

Figure 7B:
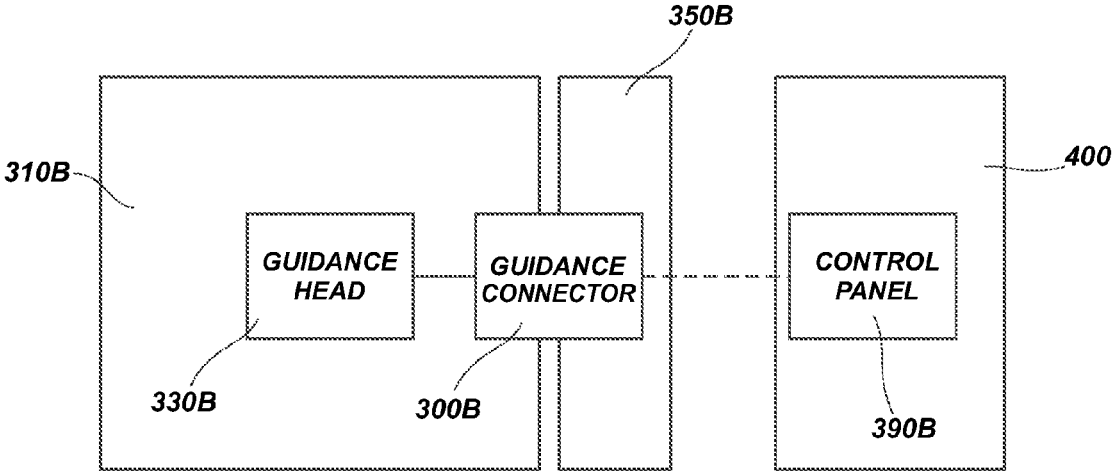

With reference to FIG. 7B, shown is an electrical schematic of the electrical communication between the guidance system of the guidance head 330B located on a rocket 310B and a control panel 390B that is located remotely from the rocket launcher 350B, wherein information can be communicated between the guidance system of the guidance head 330B of the rocket and the control panel 390B from a distance. This can be achieved wirelessly, wherein the rocket launcher comprises a transceiver operable to communicate wirelessly with the control system. This may be advantageous in some situations, such as if the rocket launcher is supported about a launch support or platform 400, or if targeting, guidance or other information is to be provided to the guidance system of the rocket by someone other than the user. By having the control panel located remotely, the rockets can be controlled remotely from the launcher. An example of a remote location might be a cockpit of a helicopter or airplane wherein the pilot is in the cockpit and the launcher is mounted outside of the vehicle. Further, with modern wireless technologies a person in a command center may be controlling the rockets. Additionally, the rocket launcher may be mounted on an unmanned vehicle and the controller may be controlling the rockets while flying or directing the unmanned vehicle both being done remotely.

Figure 8:
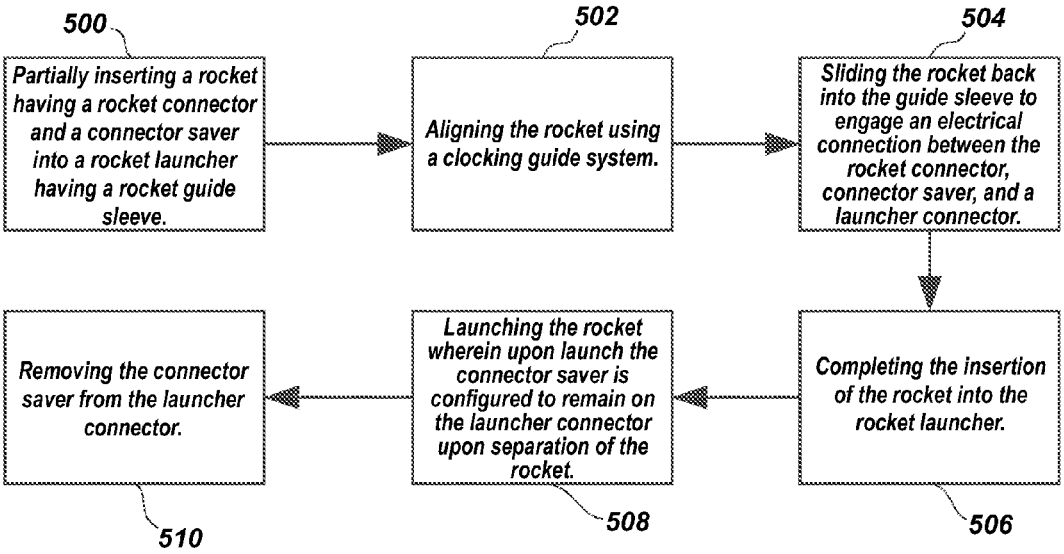
FIG. 8 illustrates a flow diagram of a method for facilitating a smart launch of a rocket from a rocket launcher.

With reference to FIG. 8, shown in is a schematic illustration of a method for facilitating a smart launch of a rocket from a rocket launcher. The method can include a first step 500 of partially inserting a rocket having a rocket connector and a connector saver into a rocket guide sleeve of a rocket launcher. The connector saver can be coupled to the rocket connector by way of a first connection. A second step 502 can include aligning the rocket using a clocking system so as to ensure proper alignment of the rocket connector and connector saver with a launcher connector supported about the rocket launcher. A third step 504 can include sliding the rocket in an aft direction to cause an electrical connection between the rocket connector and the launcher connector. It should be noted that upon insertion of the rocket into the rocket launcher a connection between the connector saver and the launcher connector is established, which can be termed a second connection. A fourth step 506 can include completing the insertion of the rocket into the rocket launcher until it is fully inserted. After insertion, the method can comprise a fifth step 508 comprising launching the rocket, wherein upon launch, the connector saver is configured to remain with the launcher connector upon separation of the rocket from the rocket launcher so as to protect the launcher connector from the conditions created by the launch of the rocket (e.g., rocket blast creating extreme temperatures within the guide sleeve). The connector saver can be configured to remain on the launcher connector because the second connection can be configured to be a dominant, or stronger, connection than the first connection, such that the first connection releases upon rocket launch. Thus upon rocket launch the connector saver is retained on the launcher connector. The method can comprise a sixth step 510 comprising removing the connector saver from the launcher connector to prepare the launcher connector for electrically coupling to a second rocket connector of a second rocket to be inserted into the same guide sleeve of the rocket launcher. This process can be repeated as often as needed as the launcher connector is never subjected to the stress of a rocket blast, but is instead always protected by a connector saver.

In addition, one skilled in the art will recognize that the launcher connector may be configured to be compatible with prior point-and-shoot dumb rockets, as discussed above, in addition to "smart" rockets as contemplated herein, wherein a connector saver that function as discussed herein may be similarly implemented on the rocket connection of the point-and-shoot dumb rocket.

Figure 9:
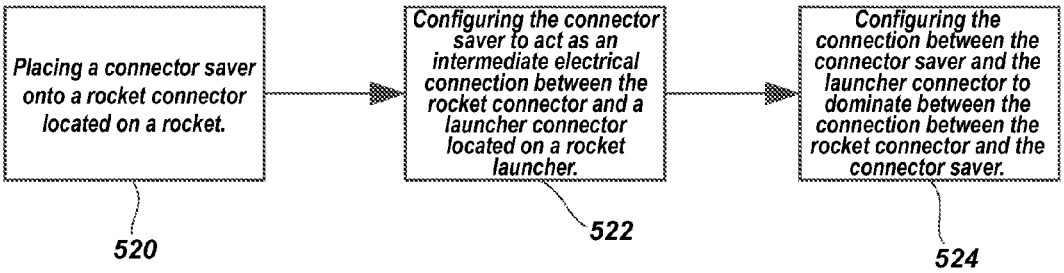
FIG. 9 illustrates a flow diagram of a method for facilitating re-use of a rocket launcher portion of a guidance section connector interface system operable with a rocket and a rocket launcher, in accordance with one exemplary embodiment of the present invention.

With reference to FIG. 9, shown is a schematic illustration relating to preparation of the rocket prior to insertion into the rocket launcher, the method comprising a first step 520 of connecting a connector saver to a rocket connector located on a rocket. The method can further comprise a second step 522 of configuring the connector saver to act as an intermediate electrical connection between the rocket connector and a launcher connector located on a rocket launcher. The method can further comprise a third step of configuring the connection between the connector saver and the launcher connector to dominate over the connection between the rocket connector and the connector saver, such that the connector saver remains connected to the launcher connector following launch of the rocket.

Prior to insertion of the rocket into the rocket launcher, a connector saver is installed onto the rocket connector thus forming a first electrical connection. As discussed above, this connection may be of any type; however, a friction fit has shown some advantages with regard to connection strength reliability. As the rocket is slid into the rocket launcher the connector saver mates with a launcher connector to form a second connection. As discussed above, this connection may be of any type; however, the second connection can be configured to dominate the first connection so as to ensure that the first connection separates or releases over the second connection. It should be noted that while any connection configurable to be stronger than the first connection is suitable, push-pull or quick-connect systems which lock when mated have provided advantages for ensuring proper strength of the connection while remaining easy to remove prior to re-loading the rocket launcher with a new rocket after firing a first rocket.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A guidance section connector interface system operable with a rocket launcher for facilitating electrical communication between a rocket and the rocket launcher, the guidance section connector interface system comprising:

a rocket connector in electrical communication with a guidance system of a rocket;

a connector saver coupled to the rocket connector to provide a first connection; and a launcher connector supported about a rocket launcher, and in electrical communication with a control system, wherein the connector saver is coupled to the launcher connector upon insertion of the rocket into the rocket launcher to provide a second connection, wherein the rocket connector, the connector saver and the launcher connector connect together to facilitate electrical communication between the rocket and the rocket launcher, wherein, upon launch of the rocket from the rocket launcher, the first connection releases, and the second connection remains connected, causing the connector saver to remain connected to the launcher connector.

2. The system of claim 1, wherein the connector saver comprises a receiver portion that operates to guide the launcher connector into correct alignment with the connector saver and the rocket connector during connection of the launcher connector and the connector saver.

3. The system of claim 1, further comprising an intermediate funnel connected between the connector saver and the launcher connector, wherein the funnel comprises a receiver portion that operates to guide the launcher connector into correct alignment with the connector saver during connection of the launcher connector and the connector saver.

4. The system of claim 3, wherein the receiver portion of the funnel comprises a conical tapered configuration.

5. The system of claim 1, further comprising a front face supported about a receiving end of the rocket launcher, the front face operating to support, at least in part, the launcher connector.

6. The system of claim 5, further comprising a clocking system operable to facilitate alignment of the connector saver and the launcher connector, the clocking system comprising:

a slot formed in the front face, and located proximate a launch rocket guide sleeve of the rocket launcher; and a guide extending from an outer surface of the rocket, wherein the guide is configured to align with and to be received within the slot to ensure proper alignment of the connector saver and the launcher connector.

7. The system of claim 1, wherein the second connection comprises a quick-connect type connection.

8. The system of claim 1, wherein the first connection comprises a friction fit.

9. The system of claim 1, further comprising:

a coupler supported about the rocket launcher;

a shaft receiver pivotally coupled to the coupler;

a slideable shaft slidably coupled to the shaft receiver, the slideable shaft being in support of the launch connector; and a biasing member configured to bias the slideable shaft relative to the shaft receiver.

10. The system of claim 9, wherein the shaft receiver is coupled to the coupler via a hinge assembly configured to provide multiple degrees of freedom of movement of the shaft receiver and the slideable shaft relative to the coupler.

11. The system of claim 9, wherein the launcher connector comprises a first component of a quick connect system, and wherein the connector saver comprises a second component of the quick connect system, the first component of the quick connect system being configured to mate with the second component of the quick connect system to connect the connector saver and the launcher connector.

12. A rocket launching system having guidance capabilities, the rocket launching system comprising:

a rocket having an on-board guidance system;

a rocket launcher operable to launch the rocket;

a control system for providing information to the guidance system of the rocket; and a guidance section connector interface system for facilitating communication between the control system and the guidance system the guidance section connector interface system comprising:

a rocket connector in electrical communication with the guidance system;

a connector saver coupled to the rocket connector at a first end thus forming a first connection; and a launcher connector supported about the rocket launcher and connected to the connector saver at a second end thus forming a second connection upon insertion of the rocket into the rocket launcher, wherein the rocket connector, the connector saver and the launcher connector connect together to facilitate electrical communication between the rocket and the rocket launcher, wherein, upon launch of the rocket from the rocket launcher, the first connection releases and the second connection remains connected, such that the connector saver remains connected to the launcher connector.

13. The system of claim 12, wherein the control system is located on the rocket launcher, and communicates the information to the guidance system via a wired connection.

14. The system of claim 12, wherein the control system is located remote from the rocket launcher, and wherein the rocket launcher comprises a transceiver operable to communicate wirelessly with the control system.

15. The system of claim 12, wherein the second connection is formed via a quick-connect type connector, and wherein the first connection is formed via a friction fit type connection.

16. The system of claim 12, wherein the guidance section connector interface system further comprises a clocking system operable to facilitate alignment of the connector saver and the launcher connector upon insertion of the rocket into the rocket launcher, the clocking system comprising:

a slot formed in a front face of the rocket launcher, and located proximate a rocket guide sleeve into which the rocket is inserted; and a guide extending from an outer surface of the rocket, wherein the guide is configured to align with and be received within the slot to ensure proper alignment of the connector saver and the launcher connector.

17. The system of claim 12, further comprising an intermediate funnel connected between the connector saver and the launcher connector, wherein the funnel comprises a receiver portion that operates to guide the launcher connector into correct alignment with the connector saver during connection of the launcher connector and the connector saver.

18. A method for facilitating a smart launch of a rocket from a rocket launcher, the method comprising:

connecting a connector saver to a rocket connector of a rocket to form a first connection, the rocket connector in electrical communication with a guidance system of a rocket;

inserting the rocket into a rocket guide sleeve of a rocket launcher;

aligning the connector saver with a launcher connector supported about a rocket launcher, and in communication with a control system;

inserting the rocket further into the rocket guide sleeve until the connector saver couples to the launcher connector to form a second connection, wherein the rocket connector, the connector saver and the launcher connector connect together to facilitate electrical communication between the rocket and the rocket launcher;

launching the rocket, causing the first connection to release the second connection to remain connected; and retaining the connector saver on the launcher connector upon launch.

19. The method of claim 18, wherein the second connection is formed via a quick-connect system.

20. The method of claim 18 further comprising:

aligning a guide supported about an upper surface of the rocket with a slot formed in a front face situated about the rocket guide sleeve;

causing the guide to enter the slot so as to ensure proper clocking of the rocket within the rocket guide sleeve, and to ensure proper alignment of the rocket connector, the connector saver, and the launcher connector.

* * * * *